United States Patent [19]

Gudgel

[11] 4,301,616

[45] Nov. 24, 1981

[54] ILLUMINATED FRISBEE TOY

[76] Inventor: Terry J. Gudgel, 15 Highmanor Dr., #8, Henrietta, N.Y. 14467

[21] Appl. No.: 95,595

[22] Filed: Nov. 19, 1979

[51] Int. Cl.[3] ..... A63H 33/26

[52] U.S. Cl. ..... 46/228; 46/74 D

[58] Field of Search ..... 46/74 D, 228, 226; 273/424, 425, 428

[56] References Cited

U.S. PATENT DOCUMENTS

| | | | |
|---|---|---|---|
| 3,720,018 | 3/1973 | Peterson et al. | 46/228 |
| 3,786,246 | 1/1974 | Johnson et al. | 46/228 |
| 3,812,614 | 5/1974 | Harrington | 46/228 |

FOREIGN PATENT DOCUMENTS

| | | | |
|---|---|---|---|
| 1172588 | 6/1964 | Fed. Rep. of Germany | 46/226 |

*Primary Examiner*—Gene Mancene

*Assistant Examiner*—Mickey Yu

*Attorney, Agent, or Firm*—Stonebraker, Shepard & Stephens

[57] ABSTRACT

A toy of the flying saucer type, to be thrown through the air from one player to another, the toy having battery-powered light emitting diodes located relatively close to the center and thus protected from abrasion or impact shock when the flying saucer hits the hand of a receiving player or hits the ground when a receiving player fails to catch it. The body of the saucer is of translucent plastic material, so that each light emitting diode creates, when lit, a luminescent area around the diode. In addition, three light guides in the form of optical fiber guides extend from each diode approximately radially outwardly to the outer rim of the flying saucer, creating illuminated areas spaced circumferentially along the outer rim of the saucer.

9 Claims, 7 Drawing Figures

ILLUMINATED FRISBEE TOY

BACKGROUND OF THE INVENTION

This invention relates to a toy of the general class of aerial toys, intended to be thrown through the air from one player to another, and more particularly to such a toy of dish shape or saucer shape, commonly known as a Frisbee or a flying saucer.

It is known in the art to provide such a toy with illuminating means, so that it may be used for playing at night. An example of this is Johnson U.S. Pat. No. 3,786,246, granted Jan. 15, 1974.

An object of the present invention is to provide an improved construction of this same general nature.

Another object is the provision of an illuminated frisbee which can be constructed more simply and economically and which is lighter than those of the prior art.

Still another object is the provision of an illuminated frisbee so constructed that the inner rim of the frisbee is smooth and free from all projections which might strike the fingers of a receiving player when he attempts to grasp the edge of a rapidly rotating frisbee thrown toward him.

A further object is the provision of an illuminated frisbee in which the source of illumination is at some distance inwardly from the rim and in which light from the source is led outwardly through light guide means to various circumferentially spaced points at the rim, for the triple purpose of enabling a larger number of points along the rim to be illuminated from a smaller number of sources of light, and of protecting the light sources from shock or abrasion occurring at the rim, and of keeping any heat that might be generated by the source of illumination at a point inwardly from the rim instead of causing heating of the rim where it might be objectionably noticeable to the fingers of the person throwing the frisbee or to the fingers of the person catching the frisbee.

DESCRIPTION OF THE PREFERRED EMBODIMENT

Figure 1:
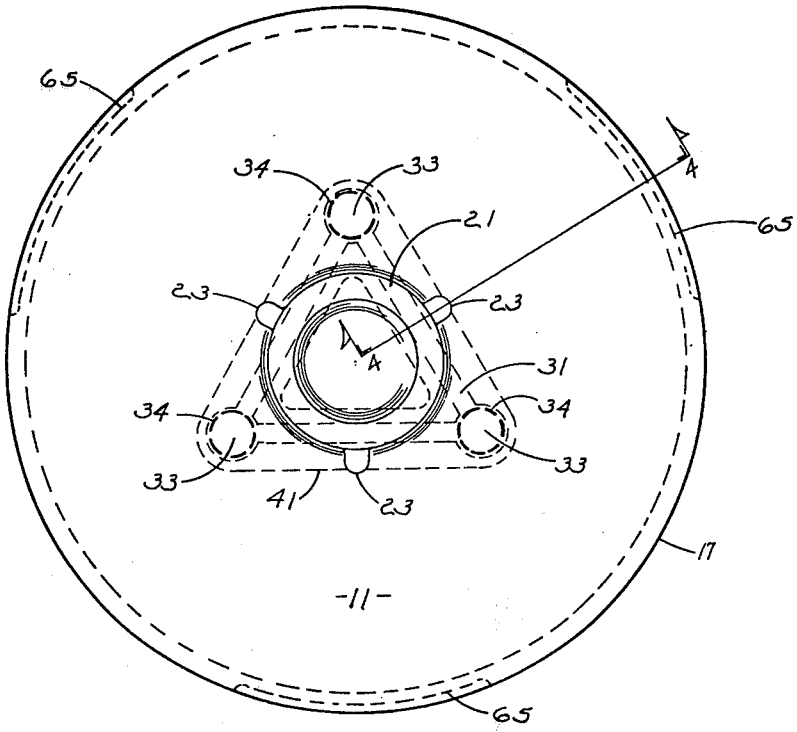
FIG. 1 is a top plan view of a device in accordance with a preferred embodiment of the invention.
Figure 2:
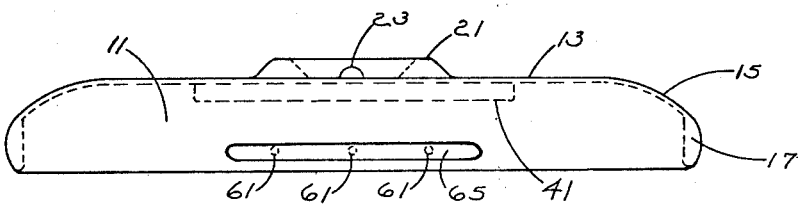
FIG. 2 is an edge view of the same.

Referring now to the drawings, and especially FIGS. 1–4, the main body of the device, indicated in general at 11, is of circular outline, and of any appropriate diameter, such for example as about ten inches, as conventional in frisbees to be thrown through the air from one person to another. The body is moulded from any conventional mouldable plastic material. It has a top wall which is flat to a considerable extent, except at its central portion, the flat part being illustrated at 13. The marginal edges curve downwardly as at 15, terminating in a thickened marginal flange 17.

Protruding upwardly from the plane of the flat portion of the top surface 13 is an annular ring 21. Spaced equally around the circumference of the ring are three hollow protuberances 23 for containing light emitting diodes 25, inserted from beneath, as will be apparent from studying FIG. 4. It will be noted from FIGS. 2 and 4 that the ring 21 is a little higher than the diode housings 23. The purpose of this ring 21 is partly to strengthen the structure in the vicinity of the center, but mainly to give improved aerodynamic characteristics to the device. As well understood by those who play with frisbees, the frisbee is thrown so that it rotates rapidly while it sails through the air. If the light emitting diode housings 23 simply projected above the top surface of the flat part 13, with no other projecting structure in the vicinity, it seems likely that these isolated projections would cause air eddies which might interfere with the smooth flow of air over the surface of the flying saucer and thus be detrimental to its aerodynamic characteristics. The addition of the concentric ring 21 serves somewhat to mask the housing projections 23, which project only a small amount beyond the ring 21, with less likelihood of interfering with the desirable aerodynamic performance.

On the underside of the main body structure there is a channel 31 of generally triangular shape, with circular cavities 33 at the corners of the triangle, arranged symmetrically and concentrically with respect to the center of the frisbee, as illustrated in FIG. 1. The housings 23 containing the light emitting diodes 25 are at the mid points of the respective sides of the triangle, as illustrated. Three small circular batteries, 34, of the flat wafer type known per se, are placed respectively in the three cavities 33 at the corners of the triangular conduit.

Figure 4:
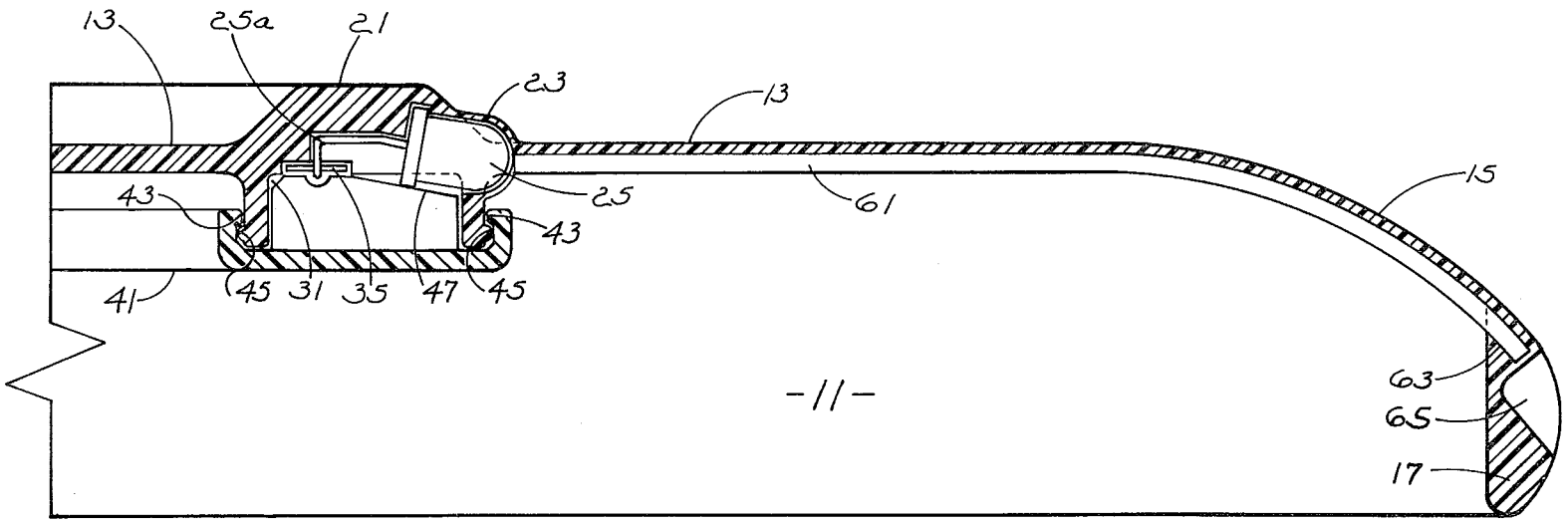
FIG. 4 is a fragmentary radial section through the same, taken approximately on the line 4—4 of FIG. 1.
Figure 5:
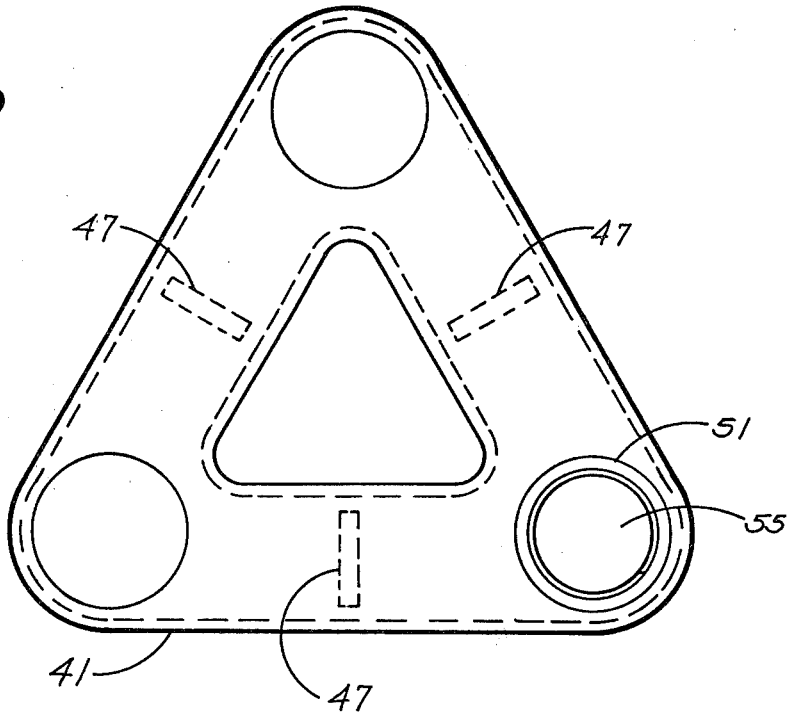
FIG. 5 is a plan view of a cover member.
Figure 6:
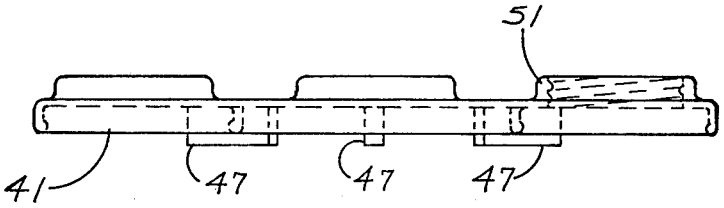
FIG. 6 is an edge view of the cover member.

In the triangular conduit the necessary circuit connections are placed, to connect the light emitting diodes 25 to the batteries. Preferably these circuit connections are in the form of a "printed circuit" on a flexible or semi-flexible base of generally triangular shape. When the device is held upside down or in an inverted position, it is easy to assemble. The light emitting diodes 25 are dropped into the cavities in the diode housings 23, the wafer batteries are dropped into position at the corners of the triangle, and the printed circuit is placed in position. The electrical leads of the diodes, shown schematically at **25*a* in FIG. 4, are so placed that they will make appropriate contact with the printed circuit shown schematically at 35 in FIG. 4. Then a cover member 41, shown separately in FIGS. 5 and 6, made of moulded plastic material, is aligned with the triangular conduit in the body and pressed down firmly onto the body (the body being in inverted position as above described) so that the beads 43 (FIG. 4) on the marginal flanges of the cover member snap over the beads 45 on the marginal flanges of the triangular channel, holding the cover member 41** firmly and tightly in place, but enabling it to be pried off when necessary to replace batteries or other parts.

Midway of each straight side of the cover member is a depending flange 47 which, when the cover member is tightly in its normal closed position, serves to hold the light emitting diode 25 firmly in place and also engages the printed circuit member 35 as seen in FIG. 4 to hold it in proper relation to the leads **25*a* of the light emitting diode 25**.

Figure 7:
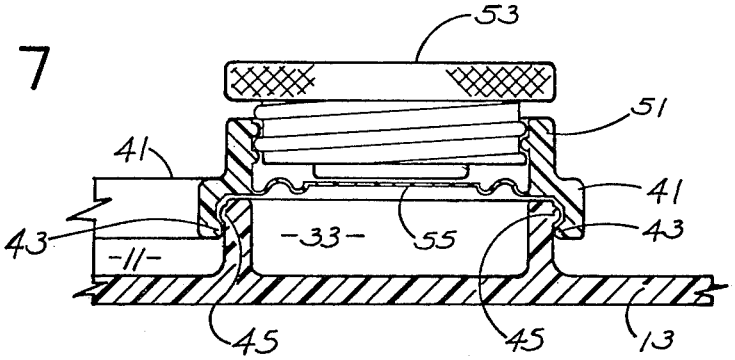
FIG. 7 is an enlarged view of a fragment of the cover member in place on the main body of the device and with a screw cap in place, which screw cap serves also as a switch for turning the light on and off.

The dimensions of the triangular channel are such that at two of the three corners, the snapping of the cover in place will hold the proper parts of the printed circuit tightly against the appropriate parts of the respective batteries at these two corners. At the third corner of the triangle, there is a different arrangement, illustrated in FIG. 7. At this corner, the cover member 41 has a circular flange which is internally threaded to mate with external threads on a screw cap 53 which, when tightly screwed down, will press a resilient diaphragm or membrane 55 inwardly to bring the battery and the circuit member into appropriate contact to complete the circuit at this point.

This constitutes the on and off switch of the device. The circuit is complete at all other points except at this corner of the triangle. If the plug 53 is slightly unscrewed or loosened, the pressure is released and the resilient diaphragm 55 springs up to separate the circuit parts, to open the circuit so that there is no drain on the batteries when the toy is not being used. When it is desired to play with this device, the plug 53 is tightened a fraction of a revolution, which completes the electric circuit contact at this point, so that all of the diodes (all of which are in parallel with each other) become lit or illuminated from the three batteries (which are in series with each other and with the parallel connection of the diodes) and the light from the illuminated diodes is visible through the translucent plastic material from which the flying saucer is made.

Figure 3:
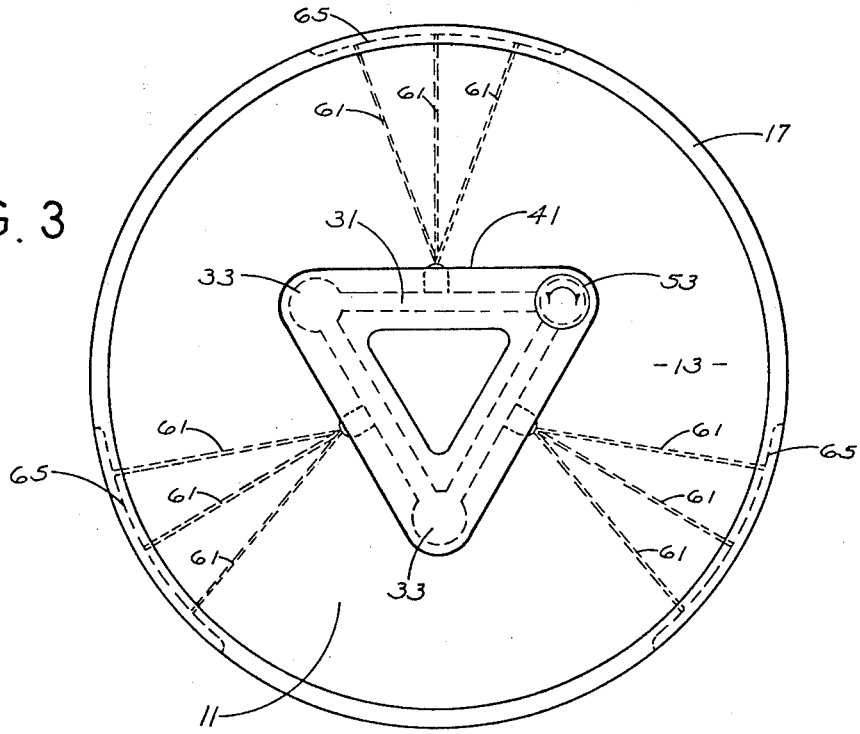
FIG. 3 is a bottom plan view of the same.

From each separate light emitting diode 25 there is means for conveying light to the margin or rim of the device so that the rim will be illuminated even though the source of light is located a substantial distance inwardly from the rim. This light conveying means is preferably in the form of fiber optics light guides or light conveying members, indicated at 61. Preferably a plurality of such light guides are used in connection with each separate source of light, three such guides being here shown, extending from each light emitting diode to the rim or periphery of the saucer, as seen in FIG. 3, although more could be used if desired.

The thickened rim 17 of the body has a small hole 63 for tightly receiving the outer end of the fiber optics member or other light guide member 61 with a snug press fit. From this point inwardly toward the light emitting diode 25, the undersurface of the body is provided with a groove which tightly receives and frictionally retains the light guide 61, with the inner end of the light guide close to the light emitting diode and separated from the diode by only a relatively thin wall of the translucent plastic material from which the body is formed, as illustrated in FIG. 4. The outer face of the thickened rim 17 has a circumferential recess 65 shaped in cross section as best seen in FIG. 4, so that there is only a very thin wall of the translucent plastic material at the exit end of the light transmission member 61. This groove 65 may extend circumferentially all the way around the body, if desired, but it is preferred to have the groove only in the vicinity of the outer ends of each group of light transmitting members coming outwardly from each individual light source 25. In other words, there would be one groove 65 sufficiently long in a circumferential direction to span the ends of the three light guides emanating from one light source 25, then the groove would terminate and the rim 17 would be of its full cross-sectional dimensions until it reaches the vicinity of the next group of light guides which emanate from the next light source, where the groove would be formed again, and so on.

In this way, the greater part of the circumference of the body would have a thickened rim of the full cross section, to give added weight and stability and spinning momentum to the device when thrown through the air. Only at spaced intervals, near the outer ends of the light guides, are the grooves 65 formed, thinning the translucent walls at these points sufficiently so that, in darkness, not only will bright light spots be seen right at the ends of the light guides 61, but also there will be a glowing effect along much of the length of the groove 65, the degree of glow being dependent upon the light permeability or translucent characteristics of the particular plastic material used in manufacturing the body. Illumination also appears through the thin plastic walls 23 of the protuberances forming the housings or cavities for the light emitting diodes or other light sources 25. Also, in the preferred form of fiber optics light guide 61, the entire length of the light guide becomes illuminated and the glow can be seen through the thin translucent walls 13, 15.

It is noted that the inner face of the thickened rim 17 is smooth all the way around the entire inner circumference, with no projections or protrusions which might strike the fingers of a player who is attempting to catch a rapidly rotating Frisbee.

The light emitting diodes 25, which constitute the preferred form of light source, operate relatively coolly. Any heat that is produced by these light sources, however, is located at a substantial distance inwardly from the rim, so does not heat up the rim or make it uncomfortable to the touch of the persons playing with these devices.

The assembly of the complete device, from its various separate parts or components, is relatively easy, and can be accomplished economically by relatively unskilled labor.

The placing of the light sources near the center rather than at the edge cushions the shock to the light sources when the rim of the article hits the hand of the receiving player or hits the ground when it is not caught by a receiving player. The use of disk-type batteries saves weight as compared with cylindrical batteries, and helps to make the construction relatively thin.

What is claimed is:

1. A toy of the Frisbee type comprising a circular body of generally dished shape having a rim, a plurality of light sources mounted on said body at points spaced substantially inwardly from said rim and arranged symmetrically with respect to the center of said body and closer to the center of the body than to the rim, and a plurality of light conductors extending from locations near each of said light sources to points on said rim, said light conductors being in the form of relatively thin optical filaments set in grooves in a face of said body and not projecting appreciably from such face, so that such face presents a relatively smooth grasping surface to a player attempting to catch the toy while it is rotating.

2. The invention defined in claim 1, wherein said body is formed of translucent plastic material, and wherein each light conductor has an inner light-receiving end separated from a light source by a thin wall of said translucent plastic material to receive light through such material and has an outer light-exit end terminating at a thin rim wall of said translucent plastic material to illuminate a portion of such rim wall from light received from the light source at the inner end of the light conductor.

3. The invention defined in claim 2, wherein three light conductors have their inner ends arranged close together to receive light from the same light source and have their outer ends substantially spaced from each other in a circumferential direction on said rim.

4. A throwable toy of the flying saucer type comprising a circular body of generally dished shape having a top surface with a downwardly curved marginal portion and a bottom surface of generally concave shape, said body having a rim, means for holding three batteries arranged approximately at the apexes of an equilateral triangle which is concentric to the center of said circular body, three light sources arranged approximately at midpoints of the sides of said triangle, means forming channels associated with the sides of said triangle to serve as conduits for electrical connections between said batteries and said light sources, and a generally triangular shaped cover member for covering said batteries and said channels.

5. The invention defined in claim 4, wherein said light sources are light emitting diodes.

6. The invention defined in claim 5, wherein said batteries are all in series with each other and said light emitting diodes are all electrically connected in parallel with each other, and in series with the batteries.

7. The invention defined in claim 4, wherein said cover member includes a screw cap at one of said apexes, said screw cap serving as an electric switch to complete an electric circuit from said batteries to said diodes when said cap is screwed down tightly and to open said circuit when said cap is loosened.

8. The invention defined in claim 4, wherein said batteries are of the disk type having greater diameter than axial length.

9. A throwable toy of the flying saucer type comprising a circular body of generally dished shape having a top surface with a downwardly curved marginal portion and a bottom surface of generally concave shape, said body having a downwardly extending rim, a plurality of batteries and a plurality of light sources mounted on said body, housing means for containing said batteries and light sources, said housing means projecting downwardly from said generally concave bottom surface near the center thereof and being located entirely inwardly from said rim sufficiently far to provide on said bottom surface a clear and substantially smooth annular area for a substantial distance radially inwardly from said rim for contact with fingers of a person catching the toy thrown at him without having his fingers engage said housing means, and light transmitting optical fibers for conveying light from said light sources outwardly to said rim, said optical fibers being sufficiently small and so placed as not to interfere with the substantially smooth character of said annular area.

* * * * *

UNITED STATES PATENT AND TRADEMARK OFFICE

CERTIFICATE OF CORRECTION

PATENT NO. : 4,301,616

DATED : November 24, 1981

INVENTOR(S) : TERRY J. GUDGEL

It is certified that error appears in the above-identified patent and that said Letters Patent is hereby corrected as shown below:

In the title "Frisbee" should read -- Flying Saucer --. Column 1, line 9, delete "a Frisbee or"; line 17, "frisbee" should read -- flying saucer --; line 21, "frisbee" first and second occurrence should read -- flying saucer --; line 24, "frisbee" should read -- flying saucer --; line 27, "frisbee"should read -- flying saucer --; line 40, "frisbee" should read -- flying saucer --; line 41, "frisbee" should read -- flying saucer --; line 64, "frisbees" should read -- flying saucers --. Column 2, line 14, "frisbees" should read -- flying saucers --; line 14, "frisbee" should read -- flying saucer --; line 32, "frisbee" should read -- flying saucer --. Column 4, line 27, "Frisbee" should read -- Flying saucer --; line 47, "Frisbee" should read -- Flying saucer --.

Signed and Sealed this

*Twelfth* Day of *June 1984*

[SEAL]

*Attest:*

GERALD J. MOSSINGHOFF

*Attesting Officer*

*Commissioner of Patents and Trademarks*